United States Patent [19]

Eng

[11] 4,408,408

[45] Oct. 11, 1983

[54] DECORATIVE MOUNTING SYSTEM

[76] Inventor: Fe C. Eng, 405 E. Seqium Bay Rd., Sequim, Wash. 98382

[21] Appl. No.: 282,095

[22] Filed: Jul. 10, 1981

[51] Int. Cl.[3] ..... G09F 17/00

[52] U.S. Cl. ..... 40/617; 40/604; 428/39; 428/99; 428/904.4

[58] Field of Search ..... 428/39, 14, 99, 187, 428/192, 904.4; 40/158 R, 604, 617; 160/327, 349

[56] References Cited

U.S. PATENT DOCUMENTS

| | | | |
|---|---|---|---|
| 1,544,507 | 6/1925 | Van Bibber | 428/187 X |
| 1,606,724 | 11/1926 | Rutman | 428/39 |
| 1,638,311 | 8/1927 | Andrews | 428/39 |
| 1,648,020 | 11/1927 | Labram | 428/39 |
| 2,765,487 | 10/1956 | Foster | 160/349 X |
| 3,237,778 | 3/1966 | Hoodis | 160/327 |
| 3,350,045 | 10/1967 | Mayers | 428/900 X |
| 3,574,017 | 4/1971 | Kass | 428/39 X |
| 3,577,307 | 5/1971 | Baier et al. | 428/911 X |
| 3,862,876 | 1/1975 | Graves | 428/83 |
| 3,916,838 | 11/1975 | Swart | 428/187 X |
| 4,223,056 | 9/1980 | DiFronzo | 428/100 X |

FOREIGN PATENT DOCUMENTS

| | | | |
|---|---|---|---|
| 37519 | 3/1965 | Fed. Rep. of Germany | 40/617 |

*Primary Examiner*—Henry F. Epstein

*Attorney, Agent, or Firm*—Cole, Jensen & Puntigam

[57] ABSTRACT

Decorative and ornamental hanging and mounting system for art work, graphics and the like utilizing a fabric base material, a cloth edging material and decorative edge strips together with a decorative hanging means at the upper edge of and a decorative weighted member at the lower end of the base fabric both of which weights are detachably secured to the base fabric.

3 Claims, 9 Drawing Figures

DECORATIVE MOUNTING SYSTEM

BACKGROUND OF THE INVENTION

The invention relates to decorative or ornamental systems, and more particularly to a decorative and ornamental hanging or mounting system for art work and the like.

The art of preparing decorative products for ornamentation has been in practice in one form or another for centuries. Some forms of decorative products are as old as civilization itself and include woven tapestry, stitched rugs, paintings and other pictorial and graphic compositions of every kind. All of the forms of ornamentation have invariably required highly developed skills and a considerable period of time to complete. For instance, old Chinese scrolls on which caligraphy or other forms of art work are inscribed are extremely old and well known. Furthermore, every manner of display of decorative or ornamental hangings or mountings has its own distinctive characteristics. Thus, different materials, arrangements of the materials used and the different functional aspects thereof in addition to the art work all contribute to the distinctiveness of a particular art form.

One problem associated with most all hanging type decorative ornaments is that unless they are framed on four sides they may not hang straight or the mounting may even curl to some extent.

The most relevant prior art found with respect to this invention is shown in U.S. Pat. Nos. 1,606,724; 1,648,020; 1,638,311; 3,574,017; and 3,862,876. None of the referenced U.S. patents, however, either in structure, organization or artistic arrangement is pertinent to the instant invention.

SUMMARY OF THE INVENTION

Ornamental mounting system for art work, graphics and the like which utilizes as a basic component an unframed generally rectangular base fabric material such as canvas. A cloth border material is adherred to the four borders of the base material over predetermined portions of the base material to define an art area bordered by the cloth material. The edge of the cloth border is then covered with a narrow decorative edge stripping along all four sides of the rectangular art area. The cloth border material is folded around the edge of the base material and adherred to both the front side and the back side. Decorative means such as carved wood or other materials such as plastic or metal, are detachably joined both to the upper end and the lower end of the base material as with screws or nails. Attachment of the decorative means at the upper and lower ends is accomplished by a wooden or plastic member extending along the lower and upper edges of the base fabric material around which the base material and cloth border material are preferably wrapped.

Accordingly, it is among the many features and advantages of the invention to provide an ornamental or decorative hanging which is unique and at the time is functional in such a way that the decorative members at the upper and lower ends may be interchanged. Additionally, the decorative end members may be detached and the base material rolled in a relatively small mass for storage or for moving. There can be more than one decorative member at each end or at either end. The mounting system also provides a highly asthetic and eye pleasing hanging and decoration for the walls of rooms.

DESCRIPTION OF PREFERRED EMBODIMENTS

Figure 1:
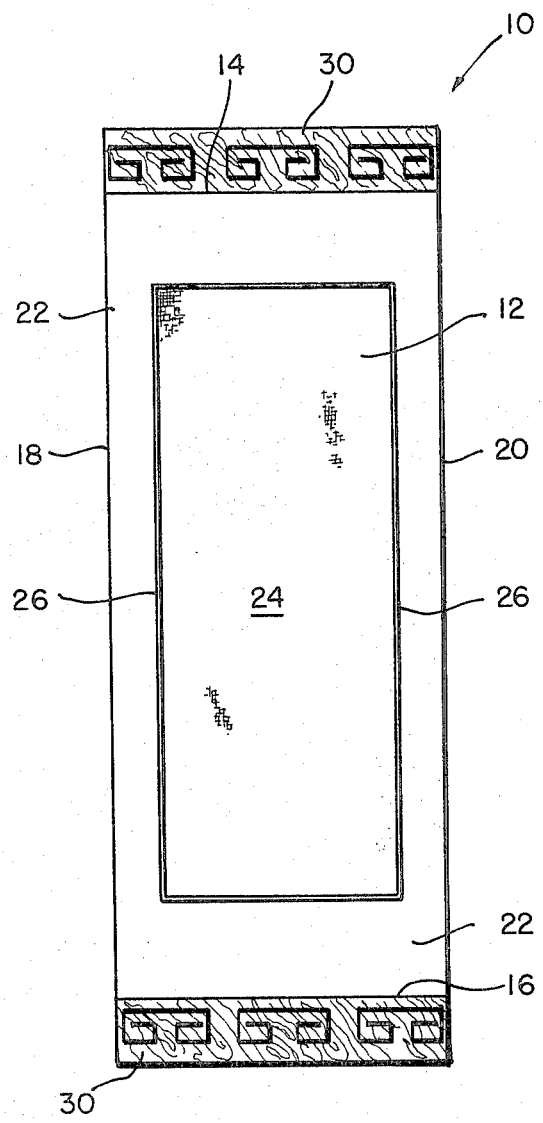
FIG. 1 is a front elevation view of a preferred embodiment of the invention.
Figure 2:
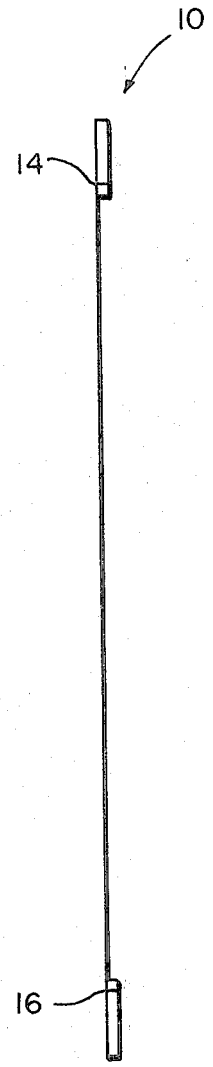
FIG. 2 is an end elevation view of FIG. 1.

FIGS. 1 and 2 show one form of the invention in its preferred embodiment. The hanging generally designated by the number 10 has a base material 12 such as canvas or the like having an upper edge 14, a lower edge 16 and side edges 18 and 20. As stated above, the base material is preferably canvas or other heavy durable cloth material forming a hanging base material. A predetermined amount of the upper, lower and side edges of the base material 12 is covered with decorative cloth material 22 to define a rectangular art or graphics area 24 on the base material 12. As will be appreciated, the precise dimensions of the base material 12 and the width of border material 22 can vary considerably. A narrow decorative edging strip 26 extends around the art area overlying the edge of the cloth border 22 and extending on to the base material 12 as best seen in FIGS. 5 through 9.

Figure 7:
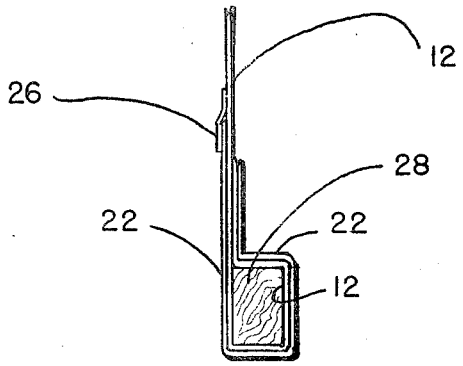
FIGS. 7–9 are partial cross section views showing additional details of the structural arrangement of the invention.
Figure 8:
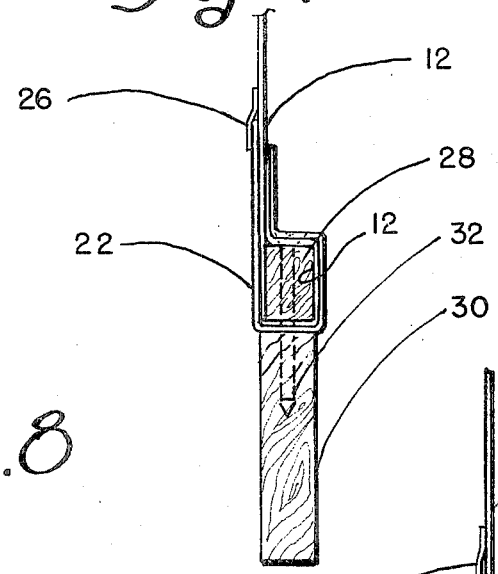
Figure 9:
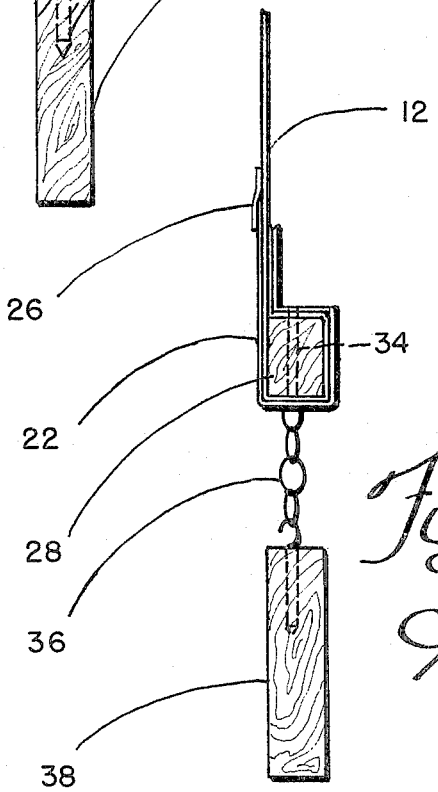

It will be seen particularly by reference to FIGS. 5 to 9 that the base material 12 and the cloth border material 22 extend around the side edges 18 and 20, lower and upper edges 14 and 16 and are adherred to the front and back surfaces of the base material 12. In the preferred embodiment, a strip of wood 28, which could also be a plastic material, extends from side to side of the base material at both the upper and lower ends and is wrapped by the folding or lapping of the base material 12 and the cloth border material 22 as best seen in FIGS. 7 through 9. The lapped portions of the base and border materials are then adherred to the back surface of the base material to hold the strip 28 securely in position.

Decorative wood members 30 are then attached to the lower and upper ends of the hanging by screws or nails 32 preferably extending through wood strip 28 and into the decorative member 30 as shown in FIG. 8.

Figure 3:
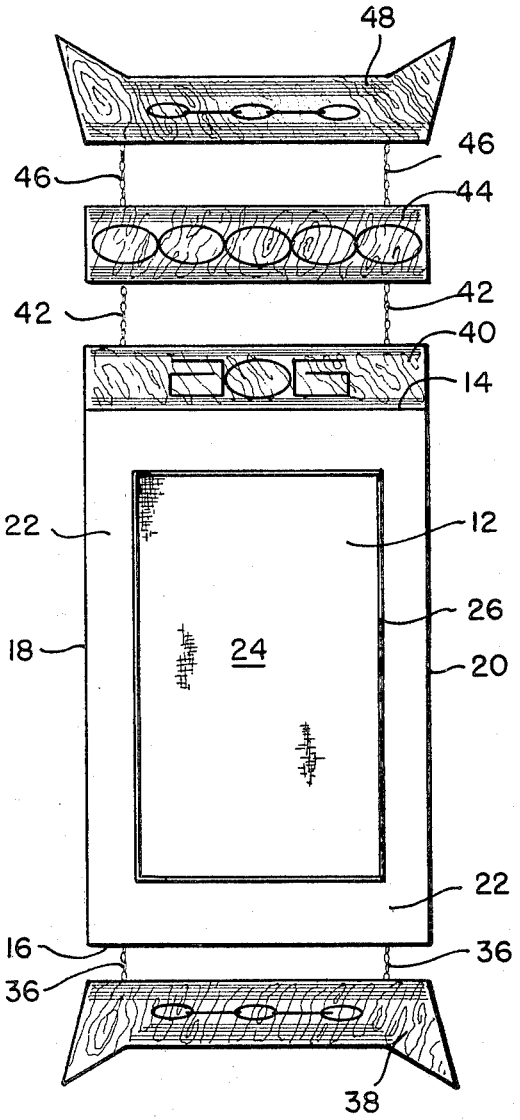
FIG. 3 is a front view of another embodiment of the invention.
Figure 4:
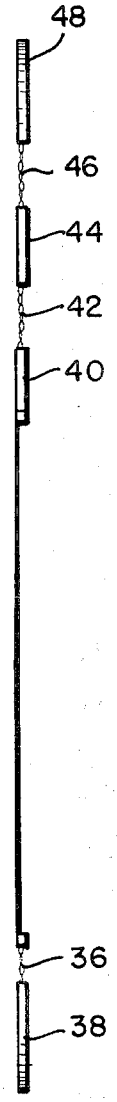
FIG. 4 is an end elevation view of FIG. 3.
Figure 5:
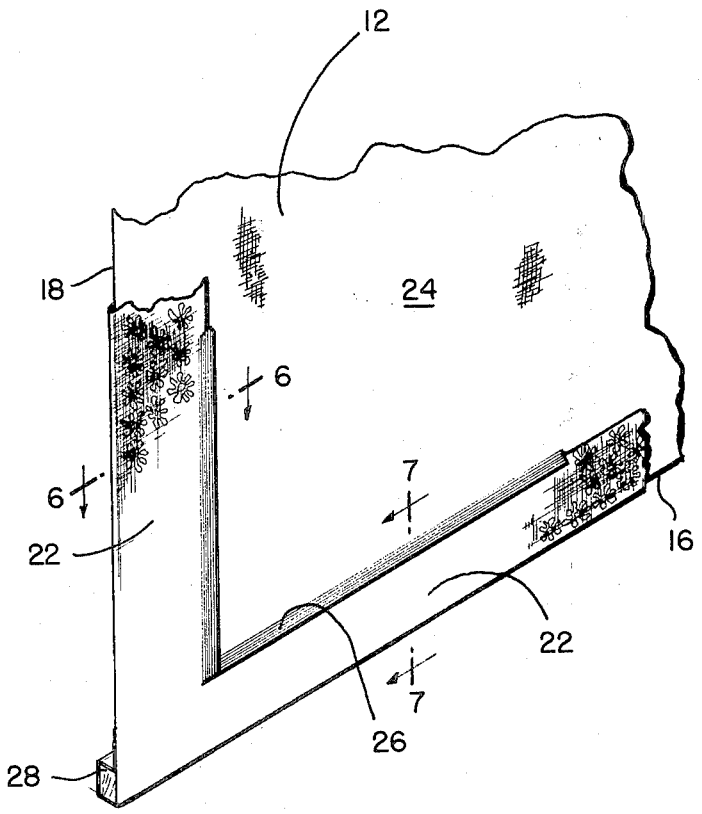
FIG. 5 is a partial view in perspective showing additional details of the invention.
Figure 6:
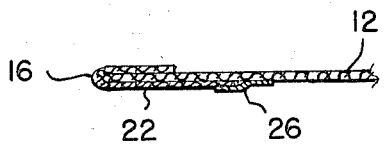
FIG. 6 is a partial cross-section view showing additional details of construction.

The embodiment of FIGS. 3 and 4 shows a slight variation from the embodiment of FIGS. 1 and 2 in that multiple decorative wood members may be used in various combinations. Thus, the basic hanging containing the art work area 24 is the same as in FIG. 1 though perhaps with slightly different dimensions and perhaps with a different colored or pattern of cloth border 22. In the embodiment shown in FIGS. 3 and 4, a pair of decorative chains 36 are attached to screw member 34 and from which will be suspended a decorative member 38. The details of FIG. 8 will be substantially the same for a wood strip member and attached decorative wood member at the upper end.

In like manner, at the upper end of the embodiment of FIGS. 3 and 4 is seen as upper wooden decorative member 40 which in turn is suspended by chains 42 from decorative wood member 44 and whence in turn is suspended by chains 46 from decorative member 48.

It will be appreciated that the decorative edging 26 is narrow and relatively thin averaging perhaps ¼ of an inch in width or more and that it can be of any desired color that is compatible with the overall asthetic effect of the hanging. The decorative wood members can certainly be longer than the canvas is wide and of course it is clear that the decorative nature of the wood members could vary over a wide range of asthetic effects and designs. The caligraphy art work, graphics, or whatever that are placed in the art area 24 usually will go on over a primer coat on the base material 12 to keep paints of either oil or water base from blurring and spreading. As with many artistic things, the art work after completion in the artistic area 24 may be painted over with varnish to seal and protect the same. In this particular instance, Chinese ink is used in many cases and because it will smear, it needs sealing. Also, it will be appreciated that both Chinese ink and oil base paint may be used in some pictures to give emphasis to desired parts of the art work.

The carved wood members at the lower and upper ends may be made plastic or even metal if desired. Also, it will be appreciated that the art area 24 need not be rectangular but that it could be many shapes such as, for example, fan shaped. There is no reason, additionally, why the hanging cannot be a greater dimension across than down.

What is claimed is:

1. Decorative hanging and mounting system for art work, graphics and the like, comprising:

a generally rectangular, flexible base fabric material having front and back surfaces and upper, side and lower ends, cloth border material adhered to the four borders of said base material over predetermined portions of the front surface of said base fabric material and folded around the edges of said base fabric material and also adhered to the back surface thereof, said fabric border material defining an art and graphic area on the front surface of and of lesser size than said base fabric material, decorative edge stripping overlying and adhered to the edges of said fabric border material and said rectangular art and graphics area, wooden securing members at each of the upper and lower ends of said base fabric material such that said wooden securing members are at least partially wrapped at least by said base fabric material at said upper and lower ends, and solid decorative weight members at the upper and lower ends detachably secured to said wooden securing members.

2. The decorative hanging and mounting system according to claim 1 and in which said cloth border material also folds around said wooden securing members and is adhered so as to eliminate any loose folds of material.

3. The decorative hanging and mounting system according to claim 2 and in which said solid decorative weight members are secured to said wooden securing members so that at least one of said decorative weight members abuts the upper or lower wooden securing members.

* * * * *